US012233323B2

(12) United States Patent
Lamash

(10) Patent No.: US 12,233,323 B2
(45) Date of Patent: Feb. 25, 2025

(54) GOLF BALL ALIGNMENT DEVICE, SYSTEM AND METHOD

(71) Applicant: Bradley Andre Lamash, Red Deer (CA)

(72) Inventor: Bradley Andre Lamash, Red Deer (CA)

( * ) Notice: Subject to any disclaimer, the term of this patent is extended or adjusted under 35 U.S.C. 154(b) by 170 days.

(21) Appl. No.: 17/972,579

(22) Filed: Oct. 24, 2022

(65) Prior Publication Data

US 2024/0131412 A1 Apr. 25, 2024
US 2024/0226694 A9 Jul. 11, 2024

(51) Int. Cl.
*A63B 69/36* (2006.01)
*A43C 19/00* (2006.01)
*A63B 71/06* (2006.01)

(52) U.S. Cl.
CPC ..... *A63B 69/3667* (2013.01); *A43C 19/00* (2013.01); *A63B 2071/0694* (2013.01)

(58) Field of Classification Search
CPC ..... A63B 69/3667; A63B 2071/0694; A63B 69/3608; A43C 19/00; A43B 1/0027; A43B 3/0078; A43B 23/24; A43B 5/001
USPC ..... 473/217–219, 266, 270–273, 409, 452
See application file for complete search history.

(56) References Cited

U.S. PATENT DOCUMENTS 2,503,586 A * 4/1950 Miller ..... A63B 69/3608 473/270
4,199,881 A * 4/1980 Francis ..... A43B 5/008 36/130
5,290,043 A * 3/1994 Vidinic ..... A63B 63/00 273/DIG. 26
2004/0159019 A1* 8/2004 Cooper ..... A63B 69/3667 36/132
2012/0108352 A1* 5/2012 Goldstein ..... A43B 3/0078 473/218
2017/0028287 A1* 2/2017 Faucette ..... A63B 69/3667

* cited by examiner

*Primary Examiner* — Nini F Legesse
(74) *Attorney, Agent, or Firm* — Capehart Law Firm

(57) ABSTRACT

A device, system and method for aligning a golf ball relative to a golf shoe is disclosed herein. The device includes a base layer and a set of alignment markings. In some embodiments, the base layer is removably adhered to a golf shoe. The system includes a pair of golf shoes each including a set of alignment markings thereon that are, in some embodiments, permanent to the golf shoes. The set of alignment markings help golfers with proper ball placement and enable the golfers to set up for the shot correctly, consistently and quickly. Particularly, the set of alignment markings assist golfers in consistently setting up the golf ball position for shots wherein the golf ball is required to be placed either on the front foot or the back foot.

5 Claims, 8 Drawing Sheets

GOLF BALL ALIGNMENT DEVICE, SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of golf accessories of existing art and more specifically relates to an alignment device, system and method particularly used for aligning a golf ball relative to golf shoes.

RELATED ART

Golf is a sport of great precision that requires a golfer to be able to consistently and accurately replicate shots. Golfers must adjust factors such as golf club used, speed of the swing, stance and foot placement relative to the golf ball in order to adjust trajectory of a shot according to what is needed. Different golf clubs require different placement of the golf ball relative to the feet of the golfer. For example, use of a wedge golf club typically requires the golfer to place the ball on their back foot (which means aligning the golf ball substantially with the back foot); whereas use of a driver golf club typically requires the golfer to place the ball on their front foot (aligning the golf ball substantially with the front foot). However, it can often take a long time for a golfer to properly align the golf ball with the appropriate foot and at an appropriate point on the foot. Further, once accurately aligned, it is difficult to replicate the exact positioning each time. Thus, a suitable solution is desired.

SUMMARY OF THE INVENTION

In view of the foregoing disadvantages inherent in the known golf accessory art, the present disclosure provides a novel golf ball alignment device, system and method. The general purpose of the present disclosure, which will be described subsequently in greater detail, is to provide a means of aligning a golf ball relative to golf shoes, that enables consistent and accurate alignment of the golf ball. Particularly, the means of aligning the golf ball attaches to, or is integral to the golf shoes.

A device for aligning a golf ball relative to a golf shoe worn on a foot of a golfer is disclosed herein. The golf shoe including a longitudinal axis defining a front portion and a rear portion; the front portion including a toe box section. The device may include a base layer and a set of alignment markings. The base layer may include a top side opposite a bottom side and may be configured for attachment to an upper side of the toe box section. The set of alignment markings may be located at the top side of the base layer. The set of alignment markings may each be spaced equally apart and oriented substantially parallel to the longitudinal axis of the golf shoe when the base layer is attached to the toe box section. The set of alignment markings may enable consistent accurate alignment of the golf ball relative to the foot of the golfer.

According to another embodiment, a system for aligning a golf ball relative to a golf shoe worn on a foot of a golfer is disclosed herein. The system may include a pair of golf shoes each including the longitudinal axis defining the front portion and the rear portion and including the toe box section. The set of alignment markings may be located at an upper side of the toe box section. The set of alignment markings may each be spaced equally apart and oriented substantially parallel to the longitudinal axis of the golf shoe. The set of alignment markings may enable consistent accurate alignment of the golf ball relative to the foot of the golfer.

According to another embodiment, a method of aligning a golf ball relative to a golf shoe worn on a foot of a golfer is also disclosed herein. The method may include the steps of: providing the system as above; positioning one of the pair of golf shoes behind the golf ball prior to taking a shot; and aligning one of the set of alignment markings with the golf ball, the one of the set of alignment markings being chosen based on type of golf club being used to take the shot.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a golf alignment device, system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to golf accessories and more particularly to a golf ball alignment device, system and method. Generally, the present disclosure may include golf shoes including vertical markings on a top side thereof (from laces of the shoes to toes of the shoes). The vertical markings may help golfers with proper ball placement and enable the golfers to set up for the shot correctly, consistently and quickly. Particularly, the vertical markings may assist golfers to consistently set up the golf ball position for shots wherein the golf ball is required to be placed either on the front foot (for example using a driver or wood golf club) or back foot (for example using a wedge golf club). As such, alignment is exact consistently.

Figure 1:
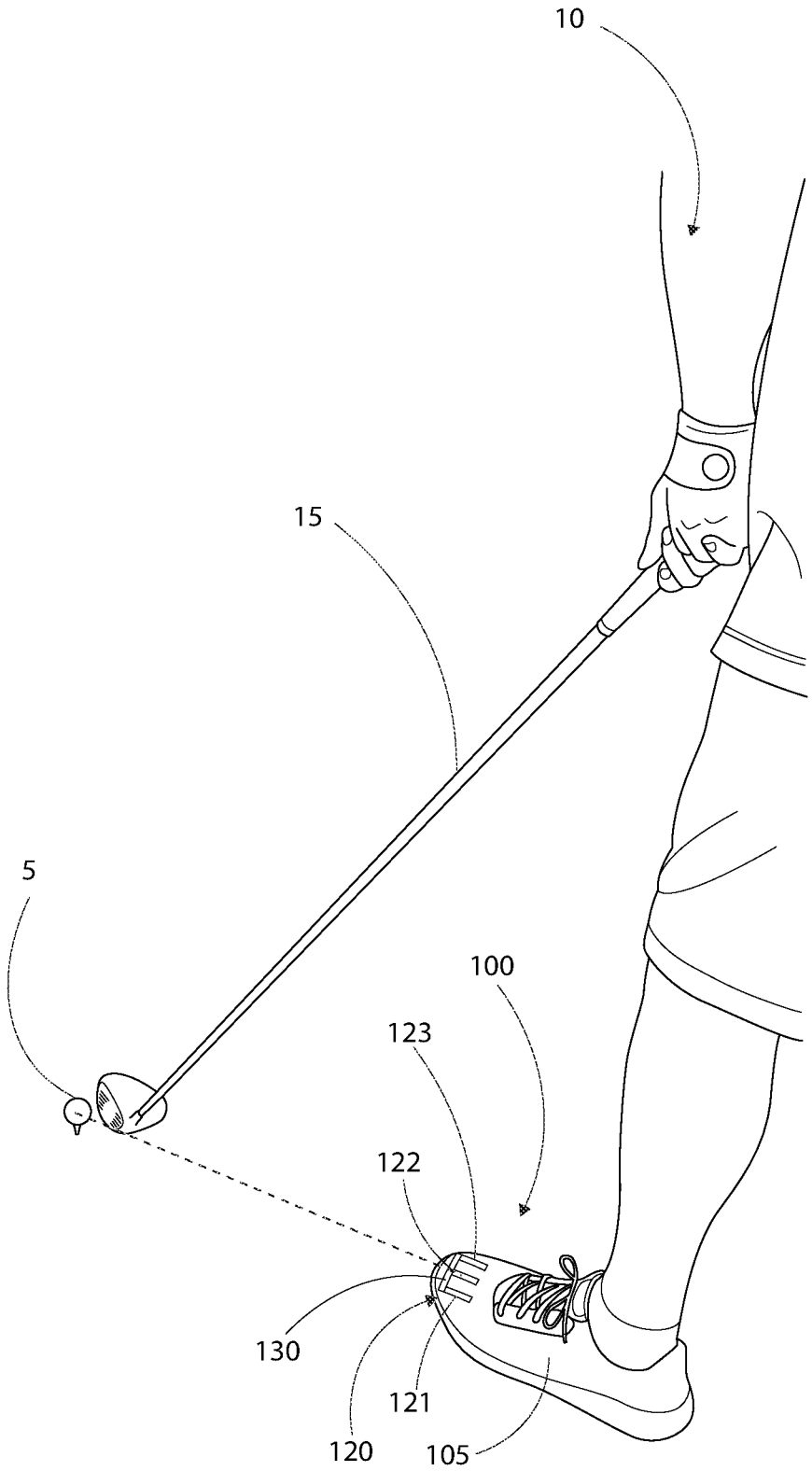
FIG. 1 is a side perspective view of a system being used to align a golf ball relative to a golf shoe for shots placed on the front foot, according to an embodiment of the disclosure.
Figure 2:
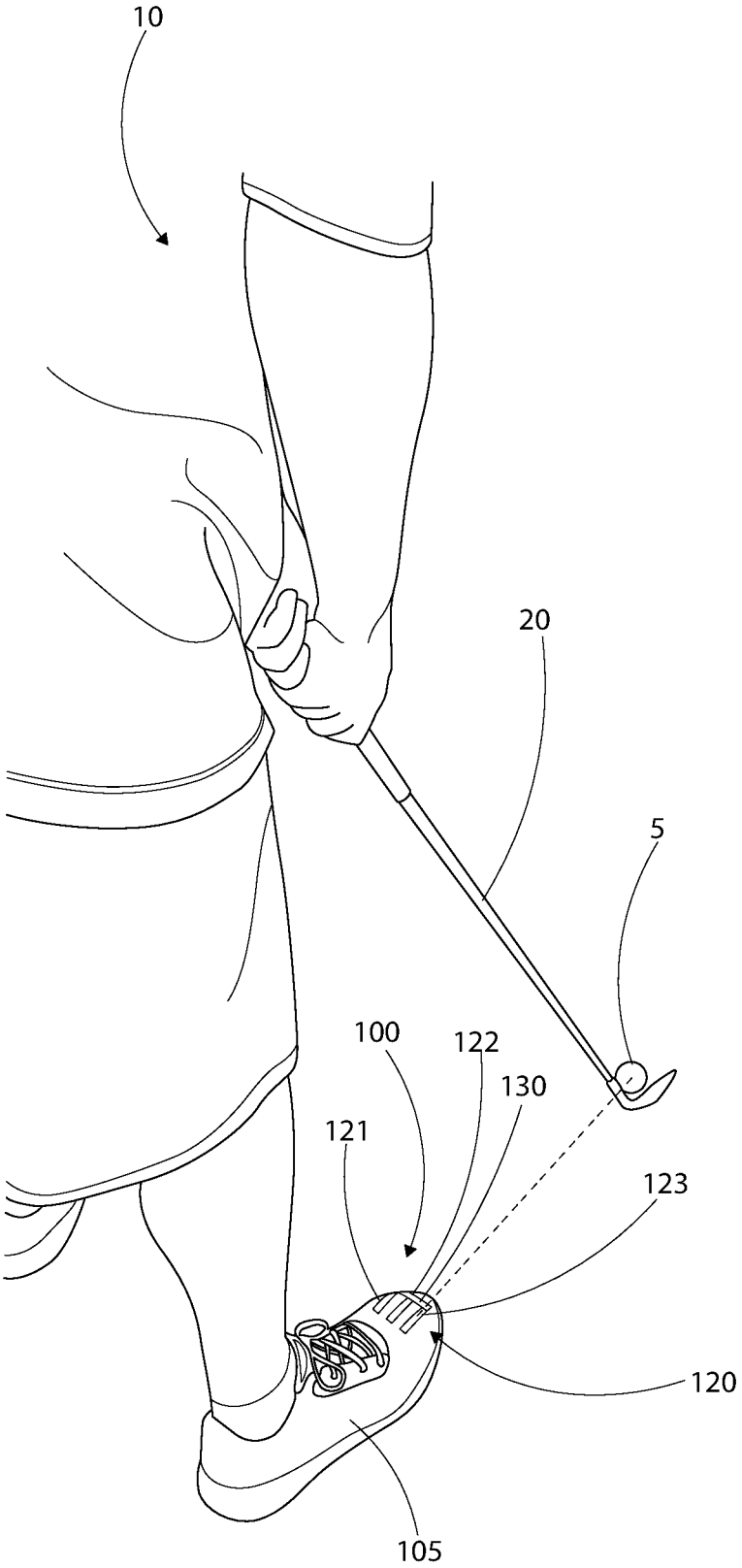
FIG. 2 is a side perspective view of the system being used to align the golf ball relative to another golf shoe for shots placed on the back foot, according to an embodiment of the disclosure.

Referring now more specifically to the drawings by numerals of reference, there is shown in FIGS. 1-9, various views of a system 100, a device 200 and a method 300. As above, in using the system 100 and/or the device 200, a golfer 10 is able to quickly position the golf ball 5 to aid in accuracy of the shots regardless of golf club used or height required. In particular, the system 100 may be useful for shots where the golf ball 5 is required to be placed either at the front foot of the golfer 10 (for example, as shown in FIG. 1, for a driver golf club 15 or for higher shots) or back foot of the golfer 10 (for example, as shown in FIG. 2, for a wedge golf club 20 or for lower shots). This would prevent the golfer 10 from taking an extended amount of time to align the golf ball 5 and feel comfortable with their footing prior to a shot.

Figure 3:
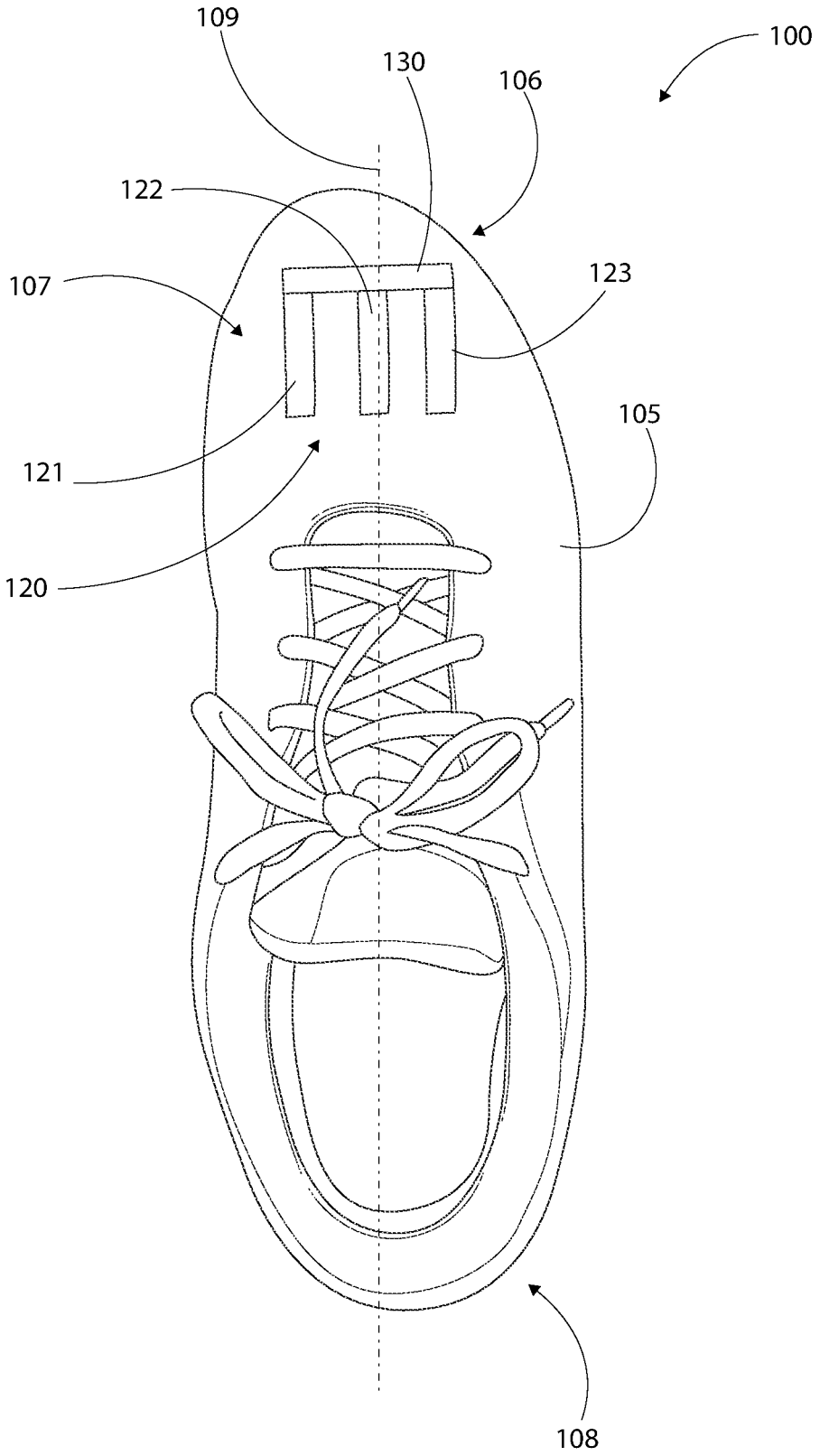
FIG. 3 is a top view of the system including a set of alignment markings, according to an embodiment of the present disclosure.
Figure 4:
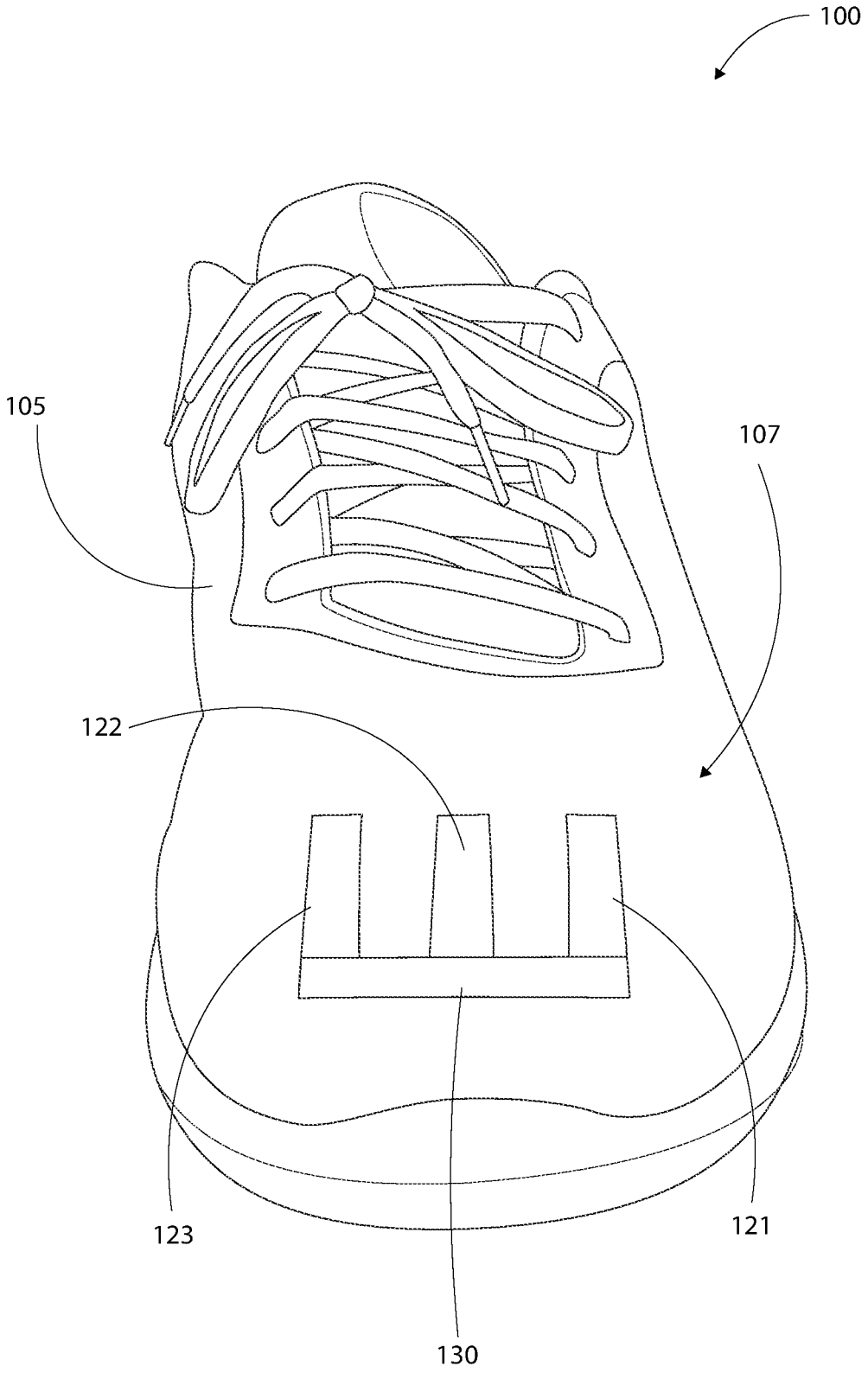
FIG. 4 is a front perspective view of the system illustrating the set of alignment markings including a first longitudinal line marking, a second longitudinal line marking and a third longitudinal line marking, according to an embodiment of the present disclosure.

In some embodiments, the system 100 may comprise a pair of golf shoes 105. As shown in FIGS. 3-4 each of the pair of golf shoes 105 may include a longitudinal axis 109 defining a front portion 106 of the golf shoe 105, and a rear portion 108 opposite the front portion 106. The front portion 106 including a toe box section 107.

As shown in FIGS. 1-4, the set of alignment markings 120 may be located at an upper side of the toe box section 107 and may enable consistent alignment of the golf ball 5 relative to the foot of the golfer 10. The set of alignment markings 120 may include (but are not limited to) a first longitudinal line marking 121, a second longitudinal line marking 122 and a third longitudinal line marking 123 all spaced equally apart. As shown, the longitudinal line markings 121, 122, 123 may all be oriented substantially parallel to the longitudinal axis 109 of the golf shoe 105, pointing toward the golf ball 5 when aligned (as demonstrated via the broken line in FIGS. 1-2), and substantially perpendicular to a target line (the imaginary path running from the golf ball 5 to the target at which the golf ball 5 is being hit). It should be appreciated that the set of alignment markings 120 may include less or more longitudinal line markings than discussed here and shown in the drawings.

The golfer 10 may align the golf ball 5 with whichever longitudinal line marking 121, 122, 123 enables them to accurately replicate each shot or achieves the height needed for a particular shot. For example, as shown in FIG. 1, for shots requiring a driver or wood, which require the golf ball 5 to be placed on the front foot, the golfer 10 may align the golf ball 5 first with their front foot and then particularly align the golf ball 5 with one of the longitudinal line markings 121, 122, 123. For instance, as shown in FIG. 1, the golfer 10 may align the golf ball 5 with the second longitudinal line marking 123. In another example demonstrated in FIG. 2, for shots requiring a wedge, which require the golf ball 5 to be placed on the back foot the golfer 10, the golfer 10 may align the golf ball 5 first with their back foot and then particularly align the golf ball 5 with one of the longitudinal line markings 121, 122, 123. For instance, as shown in FIG. 2, the golfer 10 may align the golf ball 5 with the third longitudinal line marking 123.

Further, as shown in FIGS. 1-4, the system 100 may also comprise a transverse line marking 130. As shown, the transverse line marking 130 may also be located at the upper side of the toe box section 107 of the golf shoe 105. Particularly, the transverse line marking 130 may be located at a frontmost part of the front portion 106 of the golf shoe 105 (forward of the set of alignment markings 120), traversing the toe box section 107 and oriented perpendicular to the set of alignment markings 120 (and to the longitudinal axis 109). The transverse line marking 130 may enable consistent positioning of the feet of the golfer 10 relative to the target line. Particularly, the transverse line marking 130 may enable the golfer 10 to visually confirm feet placement for a draw or a fade.

As shown in FIGS. 1-4, the set of alignment markings 120, and in some embodiments the transverse line marking 130, may be permanently attached to the golf shoe 105. For example, the set of alignment markings 120 and the transverse line marking 130 may be printed onto the upper side of the toe box section 107. In another example, the set of alignment markings 120 and the transverse line marking 130 may be die cut onto the upper side of the toe box section 107. It should however be appreciated that these means of attachment are provided as examples only and are not meant to limit the system 100 in any way. Other means of attachment may include (but are not limited to) embroidery, dye sublimation, laser engraving, laser cutting, permanent adhesive, or the like.

It should be appreciated that however the means of attachment, the set of alignment markings 120 and the transverse line marking 130 should be easily and visually distinguishable from the toe box section 107, such as using different contrasting colors, different textures, etc. For example, the toe box section 107 may include a black color and the set of alignment markings 120 may include a white color. The transverse line marking 130 may particularly include a bright color.

Referring now to FIGS. 5-8, there is shown the device 200 provided for aligning the golf ball 5 relative to the golf shoe 105 worn on a foot of the golfer 10. Again, as above, the golf shoe 105, or more preferably, pair of golf shoes 105, may each include the toe box section 107 at the front portion 106 of the golf shoe 105, the rear portion 108 opposite the front portion 106 and the longitudinal axis 109. Similar to the system 100 discussed above (FIGS. 1-4), the device 200 may enable the golfer 10 to align the golf ball 5 accurately and consistently.

As shown in FIGS. 5-8, in some embodiments, the device 200 may comprise a base layer 210 and a set of alignment markings 220. The base layer 210 may include a top side 211 opposite a bottom side 212 (FIGS. 7-8) and may be configured for attachment to the upper side of the toe box section 107 (bottom side 212 down over the toe box section 107). The set of alignment markings 220 may be located at the top side 211 of the base layer 210. For example, the set of alignment markings 220 may be (but are not limited to being) printed onto the base layer 210. Similar to what is discussed above in the system 100, the set of alignment markings 220 may include a first longitudinal line marking 221, a second longitudinal line marking 222, and a third longitudinal line marking 223 and the longitudinal line markings 221, 222, 223 may be substantially parallel to the longitudinal axis 109 of the golf shoe 105 when the base layer 210 is attached thereto (and again pointing toward the golf ball 5 when aligned, and substantially perpendicular to the target line).

Further, similar to above, the device 200 may comprise a transverse line marking 230. As shown, the transverse line marking 230 may also be located at the top side 211 of the base layer 210. Particularly, the transverse line marking 230 may be located forward of the set of alignment markings 220 at a frontmost part of the base layer 210, perpendicular to the set of alignment markings 220 (and to the longitudinal axis 109) and traversing the frontmost part of the toe box section 107 when the base layer 210 is attached thereto. Similar to above, the transverse line marking 230 may enable consistent positioning of the foot of the golfer 10 relative to the target line (or more particularly, the feet of the golfer 10 when the device 200 is worn on the pair of golf shoes 105), enabling the golfer 10 to visually confirm feet placement for a draw or a fade.

Preferably, the base layer 210 may be removably attached to the pair of golf shoes 105; however, it should be appreciated that the base layer 210 may also be permanently or semi-permanently attached to the pair of golf shoes 105. The base layer 210 may take a variety of forms. For example, in some embodiments, the base layer 210 may be flexible and formed as a sticker and/or tape. As such, the bottom side 212 of the base layer 210 may include adhesive 213 (FIG. 8), enabling the golfer 10 to adhere the base layer 210 to the upper side of the toe box section 107. In this embodiment, the base layer 210 may be comprised of (but not limited to) paper, plastic, etc.

Figure 5:
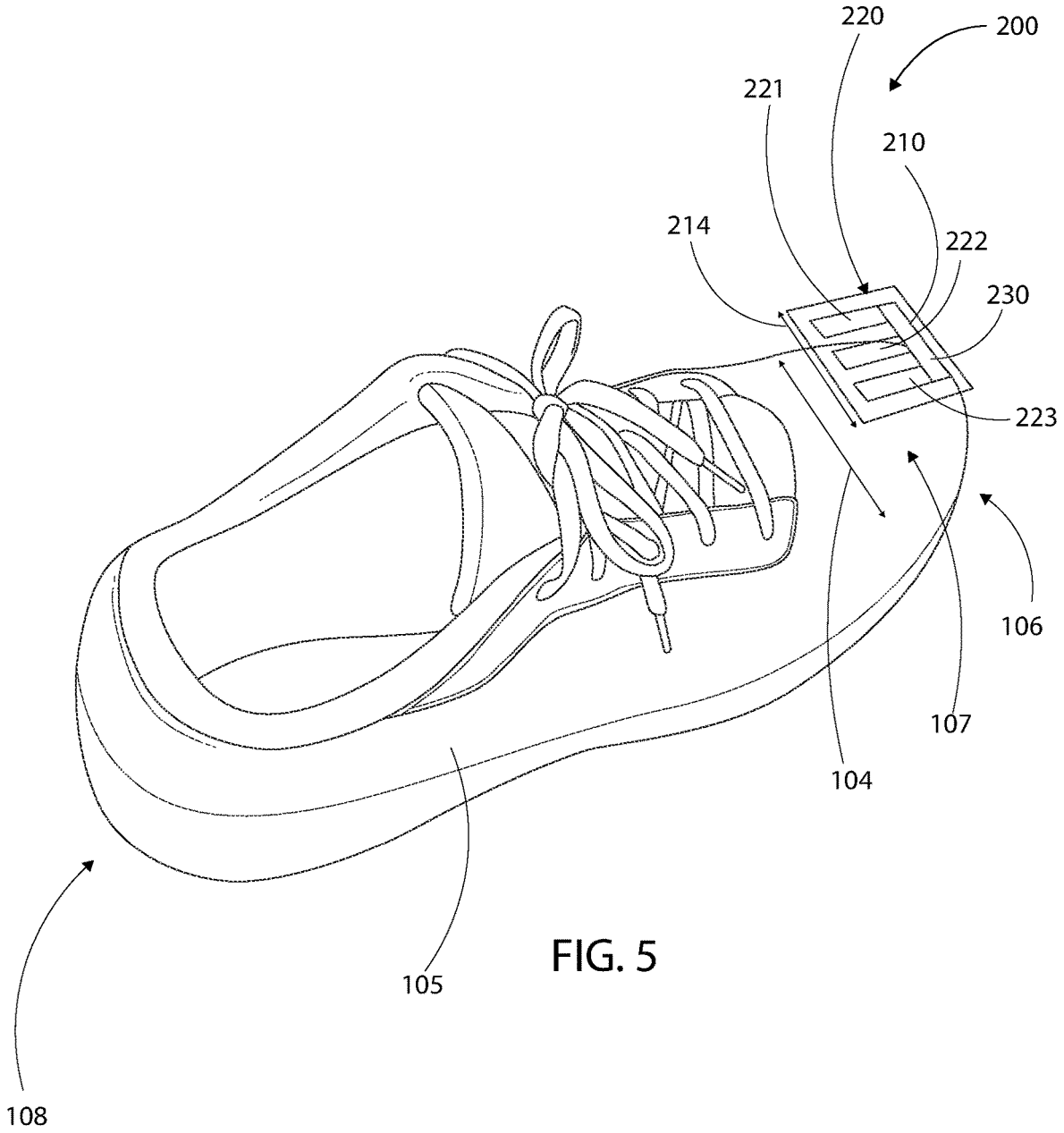
FIG. 5 is a side perspective view of a device being attached to a golf shoe, the device including a base layer and a set of alignment markings, according to an embodiment of the present disclosure.
Figure 6:
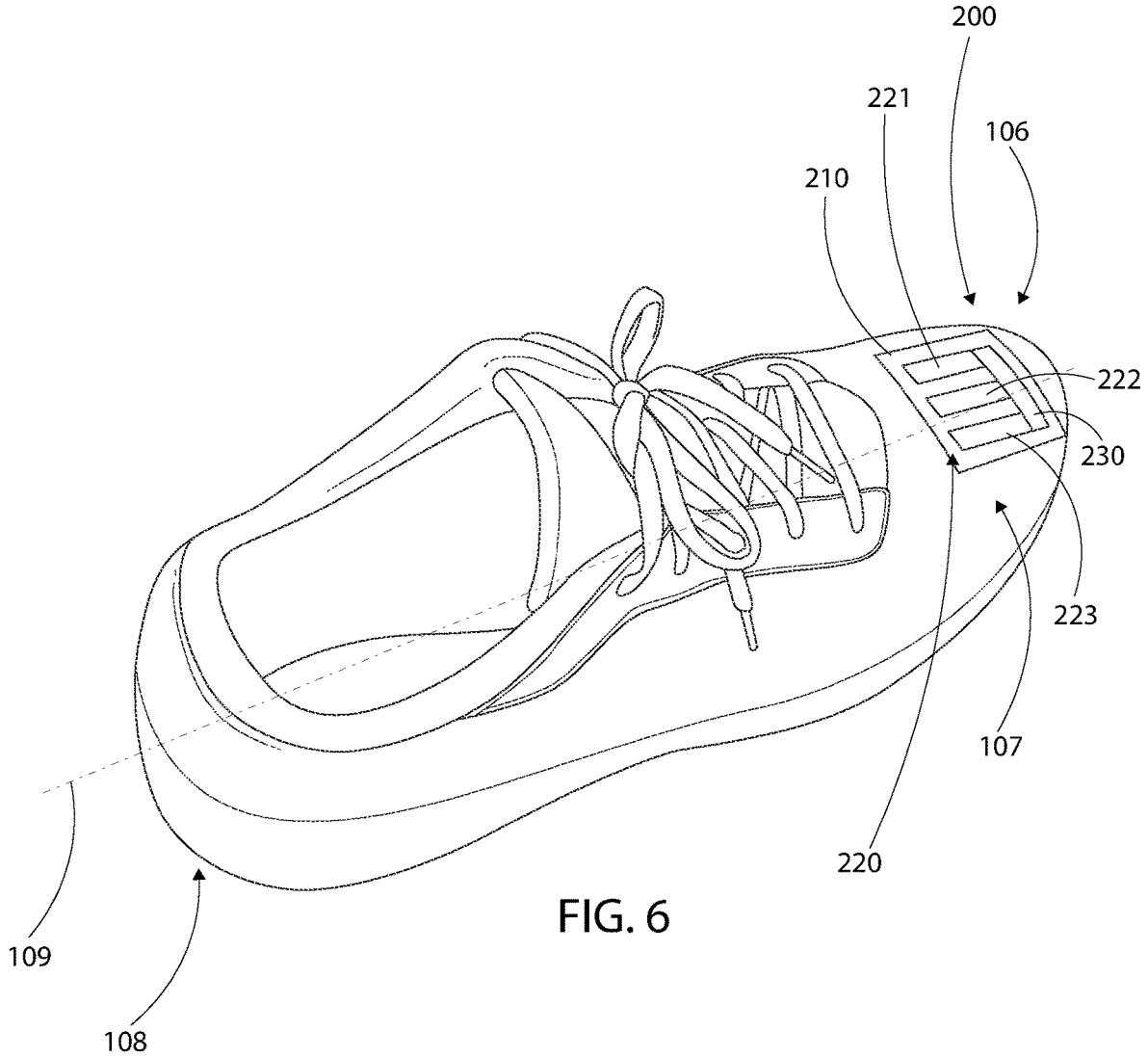
FIG. 6 is a side perspective view of the device of FIG. 5 attached to the golf shoe, according to an embodiment of the present disclosure.
Figure 7:
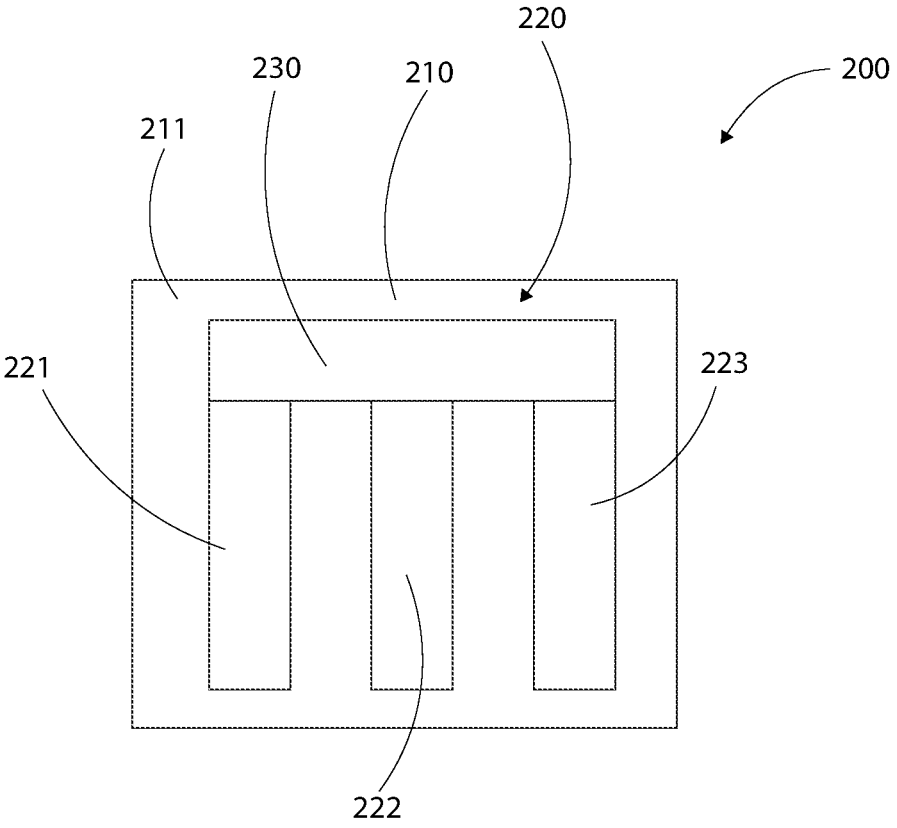
FIG. 7 is a top view of the base layer including the set of alignment markings on a top side thereof, the set of alignment markings including a first longitudinal line marking, a second longitudinal line marking and a third longitudinal line marking, according to an embodiment of the present disclosure.
Figure 8:
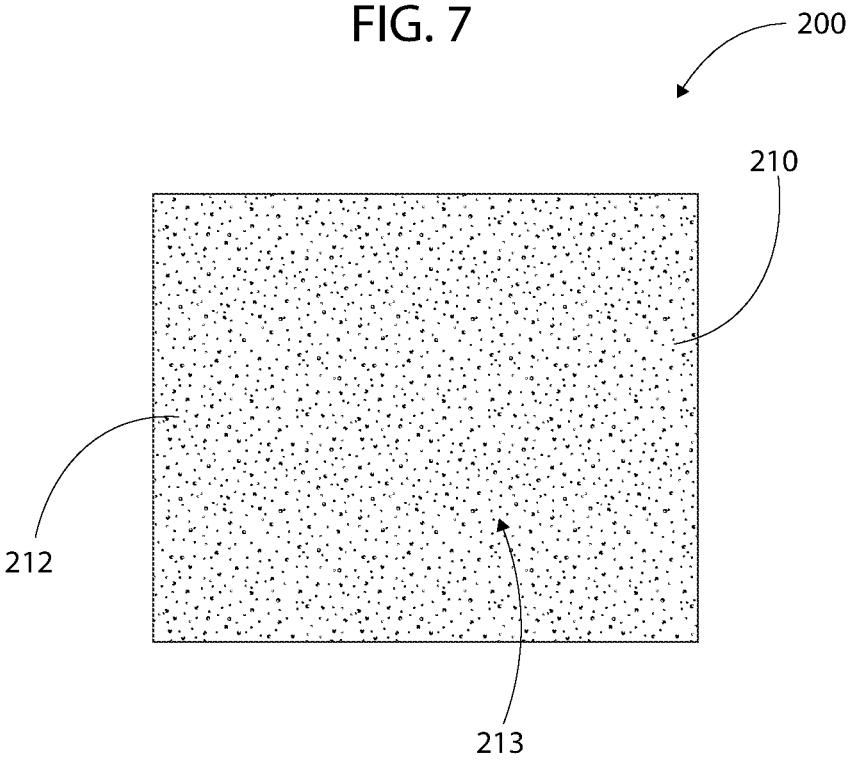
FIG. 8 is a bottom view of the base layer including adhesive on a bottom side thereof, according to an embodiment of the present disclosure.

As shown in FIG. 5, the base layer 210 may include a width 214 generally equal to, or smaller than, a width 104 of the upper side of the toe box section 107, enabling proper positioning of the set of alignment markings 220 relative to feet of the golfer 10. It should be appreciated that the device 200 is not limited to covering an entirety of the toe box section 107. It should be appreciated that the base layer 210 is not limited to including adhesive. For example, the base layer 210 may include other fasteners such as (but not limited to) straps, hook and loop fastener, pins, clips, etc. Further, the base layer 210 is not limited to being flexible.

Similar to the system 100 discussed above, it should be appreciated that however the base layer 210 is attached or what the base layer 210 is composed of, the set of alignment markings 220 and the transverse line marking 230 should be easily and visually distinguishable from the toe box section 107 (again such as using contrasting, or bright colors). Further, in some embodiments, the base layer 210 may be substantially transparent so as to not hinder visibility of the set of alignment markings 120 and the transverse line marking 230.

In some embodiments, the system 100 (as discussed above and shown in FIGS. 1-4) may also comprise the base layer 210 and the set of alignment markings 120 and the transverse line marking 130 (in some embodiments) may be located on the top side 211 thereof. Again, as above, in some embodiments, the bottom side 212 of the base layer 210 may include (but is not limited to including) the adhesive 213, enabling the golfer 10 to easily adhere the base layer 210, and thus the set of alignment markings 120 and the transverse line marking 130, to the pair of golf shoes 105 (or existing shoes). To facilitate proper placement of the base layer 210 on the toe box section 107 the base layer 210 may be flexible; again, for example, the base layer 210 may include tape and/or a sticker.

Figure 9:
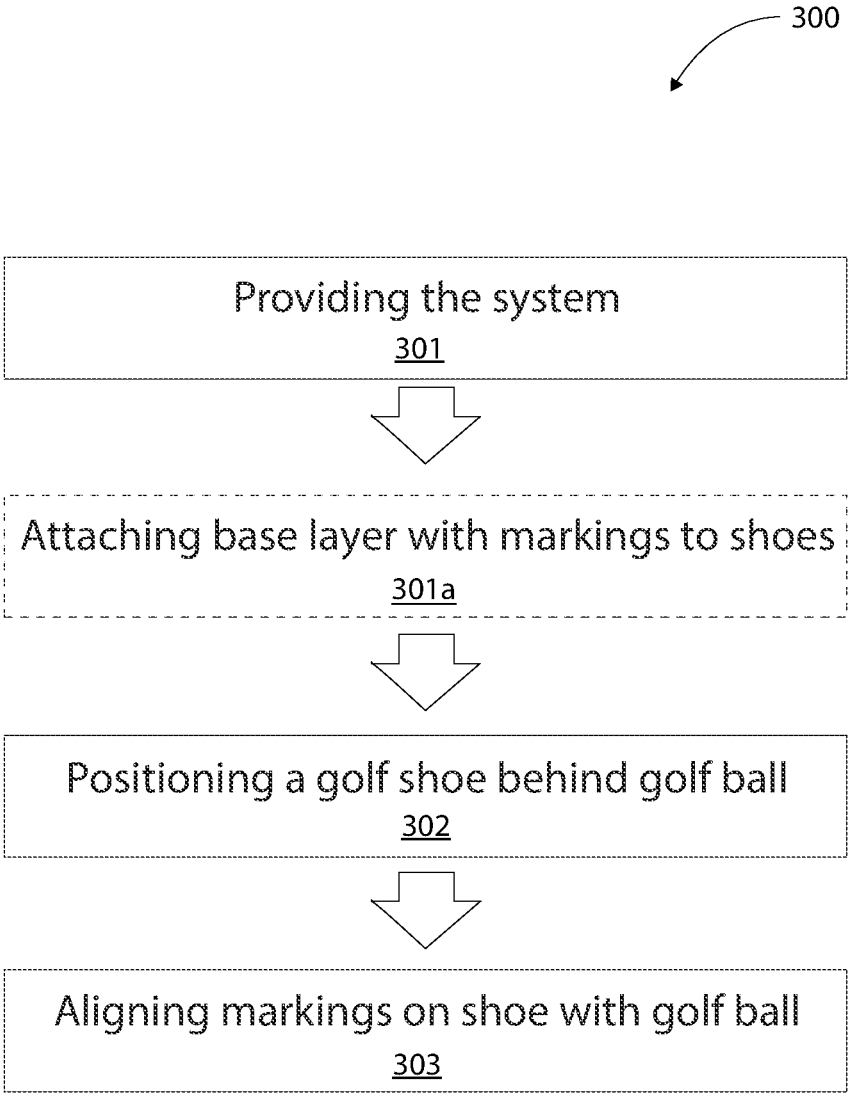
FIG. 9 is a flow diagram illustrating a method of aligning a golf ball relative to a golf shoe worn on a foot of a golfer, according to an embodiment of the present disclosure.

Referring now to FIG. 9 showing a flow diagram illustrating a method 300 of aligning a golf ball relative to a golf shoe worn on a foot of a golfer, according to an embodiment of the present disclosure. In particular, the method 300 may include one or more components or features of the system 100 and/or device 200 as described above. As illustrated, the method 300 may include the steps of: step one 301, providing the system (and/or the device) as above; step two 302, positioning one of the pair of golf shoes behind the golf ball prior to taking a shot; and step three 303, aligning one of the set of alignment markings with the golf ball, the one of the set of alignment markings being chosen based on type of golf club being used to take the shot, or height need for the particular shot.

In embodiments including the base layer, the method 300 may further comprise the step of 301*a* attaching the base layer to the upper side of the toe box section. For example, as discussed above, the base layer may be adhered to the upper side of the toe box section (prior to positioning the one of the pair of golf shoes behind the golf ball).

It should be noted that certain steps are optional and may not be implemented in all cases. It should also be noted that the steps described in the method of use can be carried out in many different orders according to user preference. Optional steps of method 300 are illustrated using broken lines in FIG. 9 so as to distinguish them from the other steps of method 300. The use of "step of" should not be interpreted as "step for", in the claims herein and is not intended to invoke the provisions of 35 U.S.C. § 212(f). It should also be noted that, under appropriate circumstances, considering such issues as design preference, user preferences, marketing preferences, cost, structural requirements, available materials, technological advances, etc., other methods for aligning a golf ball relative to a golf shoe are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A method of aligning a golf ball relative to a golf shoe worn on a foot of a golfer, comprising:

providing a system including:

a pair of golf shoes, each golf shoe including:

a longitudinal axis defining:

a front portion, the front portion including a toe box section; and a rear portion opposite the front portion; and a set of alignment markings located at an upper side of the toe box section, the set of alignment markings each spaced equally apart and oriented substantially parallel to the longitudinal axis of the golf shoe, the set of alignment markings enabling consistent accurate alignment of the golf ball relative to the foot of the golfer;

positioning one of the pair of golf shoes behind the golf ball prior to taking a shot; and aligning one of the set of alignment markings with the golf ball, the one of the set of alignment markings being chosen based on type of golf club being used to take the shot.

2. The method of claim 1, wherein the set of alignment markings include a first longitudinal line marking, a second longitudinal line marking and a third longitudinal line marking.

3. The method of claim 2, wherein the system further comprises a base layer including a top side opposite a bottom side, wherein the base layer is configured for attachment to the upper side of the toe box section, and wherein the set of alignment markings is located on the top side of the base layer.

4. The method of claim 3, wherein the method further comprises the step of attaching the base layer to the upper side of the toe box section.

5. The method of claim 4, wherein the bottom side of the base layer includes adhesive and wherein the base layer is adhered to the upper side of the toe box section.

* * * * *